US005419849A

United States Patent [19]

Fields et al.

[11] Patent Number: 5,419,849

[45] Date of Patent: May 30, 1995

[54] CLEANING FLUIDS

[76] Inventors: Paul B. Fields, R.R. 2-Box 60A, Hudson, N.Y. 12534; Larry M. Fields, 6 Soulagnet Ct., Dix Hills, N.Y. 11746

[21] Appl. No.: 80,029

[22] Filed: Jun. 18, 1993

[51] Int. Cl.[6] ..... C11D 7/30; C11D 7/50; B08B 3/04; D06L 1/02

[52] U.S. Cl. ..... 252/171; 8/142; 134/12; 134/31; 134/40; 252/170; 252/DIG. 8

[58] Field of Search ..... 252/162, 170, 171, DIG. 8; 134/12, 31, 40; 8/142

[56] References Cited

U.S. PATENT DOCUMENTS

| | | | |
|---|---|---|---|
| 2,346,622 | 4/1944 | Steck | 252/168 |
| 3,254,029 | 5/1966 | Piepmeyer | 252/152 |
| 3,925,010 | 12/1975 | Barton | 8/142 |
| 4,507,155 | 3/1985 | Cheek | 252/171 |
| 5,059,728 | 10/1991 | Li et al. | 570/134 |
| 5,104,565 | 4/1992 | Magid et al. | 252/171 |
| 5,124,063 | 6/1992 | Logsdon et al. | 252/171 |
| 5,124,064 | 6/1992 | Logsdon et al. | 252/171 |
| 5,145,523 | 9/1992 | Halpin | 252/170 |
| 5,225,099 | 7/1993 | Basua et al. | 252/171 |

FOREIGN PATENT DOCUMENTS

| | | | |
|---|---|---|---|
| 2810989 | 9/1979 | Germany | 252/171 |
| 60-4599 | 5/1985 | Japan | 252/171 |
| 1-132814 | 5/1989 | Japan . | |
| 1-141996 | 6/1989 | Japan . | |
| 2-214800 | 8/1990 | Japan . | |

*Primary Examiner*—Linda Skaling
*Attorney, Agent, or Firm*—Jordan and Hamburg

[57] ABSTRACT

A cleaning fluid for fabrics includes one or more hydrochlorofluorocarbons and/or hydrofluorocarbons, one or more alcohols, and one or more paraffinic hydrocarbons.

7 Claims, No Drawings

CLEANING FLUIDS

BACKGROUND OF THE INVENTION

The present invention relates to cleaning fluids for fabrics. The invention is suitable for use by apparel manufacturers, textile mills, retailers of apparel, textile screen printers, upholsterers, household consumers and anyone else who deals with textiles.

For many years, the most commonly used chemical in fabric spot removers was 1,1,1-trichloroethane. Spot removers typically contained either 100% 1,1,1-trichloroethane or were composed of large percentages of 1,1,1-trichloroethane.

1,1,1-trichloroethane is fast drying and effective on most "dry side" stains (such as oil, grease and dirt). Unfortunately, the Environmental Protection Agency (E.P.A.) has determined 1,1,1-trichloroethane is a "Class 1" ozone depleting substance.

To protect the environment, the E.P.A. has placed a progressive tax on 1,1,1-trichloroethane and has created a phase out schedule for 1,1,1-trichloroethane. As of May 15, 1993, any product containing 1,1,1-trichloroethane or any product manufactured using 1,1,1-trichloroethane must bear an ozone depleting warning. This warning must be posted on all products treated with 1,1,1-trichloroethane and includes, for example, garments which have been spot cleaned using 1,1,1-trichloroethane.

There has been a great deal of effort within the industry to produce a replacement for 1,1,1-trichloroethane. Unfortunately, the available cleaning solvents are either more toxic (such as, for example, trichloroethylene, methylene chloride and perchloroethylene), highly flammable (such as, for example, petroleum distillates, alcohols, etc.) or are slow drying (such as, for example, mineral spirits). Accordingly, there is a strong need and a tremendous market for a "drop in" replacement which is less damaging to the ozone, does not pose a flammability hazard and is quick drying.

U.S. Pat. No. 3,254,029 to Piepmeyer discloses a dry cleaning detergent composition prepared by condensing a higher fatty acid with an alkanolamine. The condensate, and an excess of the alkanolamine, is then reacted at elevated temperatures with an acidic, surface-active agent. Piepmeyer does not describe or suggest a fabric cleaner having one or more hydrochlorofluorocarbons and/or hydrofluorocarbons.

U.S. Pat. No. 3,925,010 to Barton discloses azeotropic mixtures of chlorodifluoroethane with amyl alcohol and water. Barton further states that the mixture of lower aliphatic alcohols and halogenated hydrocarbons for use in dry cleaning is known and that such combinations tend to be flammable and constitute a serious fire hazard. Barton does not disclose a dry cleaning solution having one or more hydrochlorofluorocarbons and/or hydrofluorocarbons in combination with one or more alcohols and one or more paraffinic hydrocarbons.

U.S. Pat. No. 2,346,622 to Steck discloses a cleaning composition having a chlorinated hydrocarbon, alcohol and paraffin wax. Steck et al do not disclose or suggest a cleaning agent having one or more hydrochlorofluorocarbons and/or hydrofluorocarbons.

U.S. Pat. No. 5,145,523 to Halpin et al discloses a liquid cleaning solution for plastic and metallic surfaces. The cleaning solution of Halpin et al includes an isoparaffin solvent (such as, ISOPAR TM "G", "H", "K" and "L") and a 4 to 10 carbon monohydric alcohol. Halpin et al do not teach or suggest the inclusion of one or more hydrochlorofluorocarbons and/or hydrofluorocarbons in a cleaning solution to be used for the cleaning of textiles.

U.S. Pat. No. 5,124,063 to Logsdon et al discloses an azeotrope-like industrial cleaning solvent used to clean printed circuit boards which is also useful for dry cleaning. Logsdon et al '063 further discloses that solvent cleaning with fluorocarbon based solvents is widespread in the industry. The composition of Logsdon et al '063 includes a hydrochlorofluorocarbon, methanol and an alkane having five or six carbon atoms. The alkane can be an isoparaffin. The composition of Logsdon et al '063 preferably comprises from about 55 to about 97.8 wt. % of 1,1-dichloro-1-fluoroethane, from about 1 to about 38 wt. % of dichlorotrifluoroethane, from about 1 to about 4 wt.% of methanol and from about 0.5 to about 15 wt. % of an alkane having five of six carbon atoms which can be an isoparaffin. Logsdon et al '063 also refers to Kokai Patent Publication 139,861, which discloses a dry-cleaning agent having 67 wt. % 1,1-dichloro-2,2,2 trifluoroethane, 33 wt. % 1,1-dichloro-1-fluoroethane plus hydrocarbons, alcohols, ketones, chlorinated hydrocarbons and surfactants. The composition of the Logsdon et al '063 patent is directed toward the cleaning of printed circuit boards and the weight percentages of its components are materially different than those of the present invention. Thus, Logsdon et al '063 does not suggest or disclose the invention as described.

U.S. Pat. No. 5,124,064 to Logsdon et al discloses an azeotrope-like composition having a slightly different composition than that described in U.S. Pat. No. 5,124,063. The Logsdon et al '064 patent discloses a cleaning composition having from about 55 to about 98 wt. % of 1,1-dichloro-1-fluoroethane, from about 1 to about 38 wt. % of dichlorotrifluoroethane, from about 0.5 to about 3 wt. % of ethanol and from about 0.5 to about 10 wt. % of an alkane having five or six carbon atoms which can be an isoparaffin. Logsdon et al '064 does not suggest or disclose the invention as described. The composition of the Logsdon et al '064 patent is directed toward the cleaning of painted circuit boards and the weight percentages of its components are materially different than those of the present invention.

SUMMARY OF THE INVENTION

According to the invention, it has been found that a mixture of one or more hydrofluorocarbons and/or hydrochlorofluorocarbons, one or more alcohols and one or more paraffinic hydrocarbons is a highly effective cleaning fluid for fabrics.

The cleaning fluid of the present invention is an excellent replacement for 1,1,1-trichloroethane. An advantage of the cleaning fluid of the present invention is that unlike other proposed substitutes for 1,1,1-trichloroethane, it has a flash point of over 100° F. The paraffinic hydrocarbon and isopropyl alcohol mixture has a flash point under 100° F. The addition of a hydrochlorofluorocarbon or hydrofluorocarbon elevates the flash point to over 100° F., eliminates the need for a "flammable liquid" warning label and makes the product much safer to use than other cleaning fluids such as alcohol and petroleum distillates.

Still another advantage of the cleaning fluid of the present invention is that it is quick drying and easy to use.

Another advantage of the cleaning fluid of the present invention is that it has a lower toxicity level than 1,1,1-trichloroethane. The cleaning fluid of the present invention has a threshold limit value (T.L.V.) of 400 ppm as opposed a T.L.V. of 350 ppm for 1,1,1-trichloroethane. The cleaning fluid of the present invention is also much less toxic than other available cleaning solvents (such as, for example, tricholoroethylene, methylene chloride and perchloroethylene).

A still further advantage of the present invention is that the inclusion of a hydrofluorocarbon or a hydrochlorofluorocarbon does not trigger a requirement for an ozone depletion warning. Yet another advantage of the present invention is that hydrofluorocarbons have absolutely no ozone depleting effects.

The cleaning fluid of the present invention is particularly useful as a spot remover for fabrics. The cleaning fluid is generally applied to the stain with a cloth or through a high pressure spotting gun, although other processes of application may be contemplated by one with ordinary skill in the art.

DETAILED DESCRIPTION OF THE INVENTION

The cleaning fluid of the present invention preferably includes from about 5 to about 50 wt % of one or more hydrochlorofluorocarbons and/or hydrofluorocarbons, from about 0 to about 30 wt % of one or more alcohols and from about 25 to about 75 wt % of one or more paraffinic hydrocarbons.

Suitable paraffinic hydrocarbons include:

ISOPAR E—isoparaffin mixture with a range of from C8 to C10

ISOPAR G—isoparaffin mixture with a range of from C10 to C14

Other suitable paraffinic hydrocarbons include, for example, a mixture of C5 to C13 isoparaffins, a mixture of C5 to C13 cycloparaffins and a mixture of C6 to C13 normal paraffins, or mixtures thereof. Preferably, a mixture of C8 to C10 isoparaffins, a mixture of C6 to C9 isoparaffins, or a mixture of C9 to C13 isoparaffins is used.

Suitable alcohols include, for example, isopropyl alcohol, methyl alcohol, propyl alcohol, n-butyl alcohol, ethyl alcohol and isobutyl alcohol. Preferably, isopropyl alcohol, n-propyl alcohol and secondary butyl alcohol are used.

Suitable hydrofluorocarbons include, for example, "GENESOLV 3000", manufactured by Allied Signal which has a boiling point of 150°-160° F., a liquid density of 1.5-1.6 g/cc, a solubility parameter of 7.6 cal/cc, a heat of vaporization of 65 Btu/lb, no flashpoint, a life time of about 10 to 30 years, and a threshold limit value (TLV) of 400 to 500ppm. Additionally, "GENESOLV 3000" is a liquid HFC having low surface tension, low viscosity and zero ozone depletion.

Suitable hydrochlorofluorocarbons include, for example, dichlorofluoroethane, dichlorotrifluoroethane and dichloropentafluoropropane.

One of the most preferred embodiments of the present invention includes about 5 wt % to about 50 wt. % hydrofluorocarbon, from about 0 wt % to about 30 wt. % alcohol and from about 25 wt % to about 75 wt % paraffinic hydrocarbons. Hydrofluorocarbons are ozone friendly and are completely non-ozone depleting.

A preferred embodiment of the present invention includes about 36 wt % 1,1-dichloro-1-fluoroethane (known in the art as HCFC 141b), about 9 wt % isopropyl alcohol and about 55 wt % paraffinic hydrocarbons.

Another preferred embodiment of the present invention includes about 36 wt % 1,1-dichloro-1-fluoroethane (HCFC 141b), about 9 wt % isopropyl alcohol and about 55 wt % of a mixture of C8 to C10 isoparaffins. The overall ozone depleting potential of this embodiment is approximately 20 to 25% less than that of straight 1,1,1-trichloroethane. Under the guidelines established by the E.P.A., this embodiment is not a "Class 1" ozone depleting substance and does not require an "ozone depletion warning" on materials cleaned with this cleaning fluid.

The following examples of cleaning fluids further illustrate the invention.

| | |
|---|---|
| Example 1 | |
| dichlorofluoroethane (HCFC 141b) | 36% by weight |
| isopropyl alcohol | 9% by weight |
| paraffinic hydrocarbons | 55% by weight |
| the paraffinic hydrocarbons are a mixture of isoparaffins with a carbon atom range of C8 through C10 | |
| Example 2 | |
| dichlorofluoroethane | 30% by weight |
| n-propyl alcohol | 13% by weight |
| isoparaffin (C8 to C10 mixture) | 57% by weight |
| Example 3 | |
| dichlorofluoroethane | 40% by weight |
| secondary butyl alcohol | 15% by weight |
| isoparaffin (C8 to C10 mixture) | 45% by weight |
| Example 4 | |
| "GENESOLV 3000" | 20% by weight |
| isopropyl alcohol | 10% by weight |
| paraffinic hydrocarbons | 70% by weight |

Having now fully described the invention, it will be apparent to one of ordinary skill in the art that many changes and modifications can be made thereto without departing from the spirit or scope of the invention as set forth herein.

What we claim is:

1. A cleaning mixture comprising 30–40 wt % of dichlorofluoroethane, 9 to 15 wt. % of a monohydric alcohol having from 1 to 4 carbon atoms and 45 to 57 wt. % of a paraffinic hydrocarbon selected from the group consisting of C8 to C10 isoparaffinic hydrocarbons, and mixtures of these paraffinic hydrocarbons.

2. A method of removal of a stain from a fabric comprising applying a cleaning mixture according to claim 1 to the stain.

3. A cleaning mixture comprising dichlorofluoroethane wherein said dichlorofluoroethane comprises about 36 wt % of the mixture, isopropyl alcohol wherein said isopropyl alcohol comprises about 9 wt % of the mixture, and a mixture of C8 to C10 isoparaffins wherein said isoparaffins comprise about 55 wt % of the mixture.

4. A cleaning mixture comprising a composition of dichlorofluoroethane, wherein said dichlorofluoroethane comprises about 36 wt. % of the composition; isopropyl alcohol, wherein said isopropyl alcohol comprises about 9 wt. % of the composition; and a mixture of C8 to C10 isoparaffins, wherein said mixture of C8 to C10 isoparaffins comprises about 55 wt. % of the composition.

5. A method of removal of a stain from a fabric comprising applying a cleaning mixture according to claim 4 to the stain.

6. A cleaning mixture comprising dichlorofluoroethane which comprises 30 wt. % of the mixture; n-propyl alcohol which comprises 13 wt. % of the mixture; and a C8 to C10 isoparaffin which comprises 57 wt. % of the mixture.

7. A cleaning mixture comprising dichlorofluoroethane which comprises 40 wt. % of the mixture; secondary butyl alcohol which comprises 15 wt. % of the mixture; and a C8 to C10 isoparaffin which comprises 45 wt. % of the mixture.

* * * * *